United States Patent [19]

Kitamura et al.

[11] Patent Number: 4,764,046

[45] Date of Patent: Aug. 16, 1988

[54] FLUID STORING MEMBER AND ITS FLUID OUTLET OPENING/CLOSING MECHANISM

[75] Inventors: Yukizo Kitamura, 1-24-16, Hanayashiki, Kawanishi-shi, Hyogo-ken; Tetsuji Kousaka, Osaka, both of Japan

[73] Assignee: Yukizo Kitamura, Hyogo, Japan

[21] Appl. No.: 30,187

[22] Filed: Mar. 26, 1987

[30] Foreign Application Priority Data

Apr. 10, 1986 [JP] Japan ..... 61-83156

[51] Int. Cl.[4] ..... A46B 11/00

[52] U.S. Cl. ..... 401/270; 401/100; 401/274; 401/284; 222/162; 222/500; 222/196.1; 137/43

[58] Field of Search ..... 222/500, 162, 196.1, 222/196.4, 196.5; 251/65; 137/43; 401/199, 268, 269, 270, 100, 273, 176, 284, 274

[56] References Cited

U.S. PATENT DOCUMENTS

| | | | |
|---|---|---|---|
| 527,726 | 10/1894 | Schneider et al. | 222/500 X |
| 534,011 | 2/1895 | Sampsell | 401/269 X |
| 1,253,032 | 1/1918 | Hardin | 401/273 |
| 1,470,049 | 10/1923 | Barrows | 222/500 |
| 2,425,313 | 8/1947 | Hammerstein | 222/500 |
| 2,869,563 | 1/1959 | Schoengrun | 251/65 X |
| 2,940,106 | 6/1960 | Hopkins | 401/100 |
| 3,491,790 | 1/1970 | Sanford | 251/65 X |
| 4,121,741 | 10/1978 | Adamson | 251/65 X |
| 4,261,485 | 4/1981 | Borg | 222/500 |

FOREIGN PATENT DOCUMENTS 1351196 4/1974 United Kingdom .

*Primary Examiner*—Richard J. Apley
*Assistant Examiner*—David J. Bender
*Attorney, Agent, or Firm*—Edwin E. Greigg

[57] ABSTRACT

A fluid outlet opening/closing mechanism and a fluid storing member equipped with this mechanism including a valve seat having a portion formed of a magnetic material, housed in the fluid storing member and adapted to be attached to an outlet portion of the fluid storing member, and a valve member having a portion formed of a magnetic material and adapted to be seated on the valve seat. At least either of the magnetic portions respectively of the valve seat and of the valve member is constituted by a material capable of generating a magnetic field.

10 Claims, 2 Drawing Sheets

FLUID STORING MEMBER AND ITS FLUID OUTLET OPENING/CLOSING MECHANISM

BACKGROUND OF THE INVENTION

1. Field of the Invention

The present invention relates to a fluid storing member and its fluid outlet opening/closing mechanism, for instance, a manicure liquid storing member and its liquid outlet opening/closing mechanism of a manicure liquid applying device used for storing a predetermined amount of manicure liquid and for guiding one-use amount of the liquid to an applying portion disposed at a leading edge of the manicure applying device such that the manicure liquid may be applied to nails.

2. Description of the Prior Art

A known manicure liquid applying device described above, as shown in FIG. 5, comprises a bottom-equipped cylindrical storing member 11 capable of storing a predetermined amount of manicure liquid and, integrally provided therewith, a liquid guiding section for temporarily storing one-use amount of the manicure liquid supplied from the storing member 11 and at the same time for guiding the liquid to an applying section 15 disposed at a leading edge of the device, the storing member 11 including at an outlet portion 11a thereof a liquid outlet opening/closing mechanism. This liquid outlet opening/closing mechanism includes a stem 16 mounting at a leading edge thereof the applying portion 15, a valve member 13 outwardly engaging a central portion of the stem 16 and normally urged toward the leading edge by a spring 17 and a valve seat 12 onto which the valve member 13 is to be seated.

For opening the above liquid outlet opening/closing mechanism, the applying portion 15 is pressed from outside by pressing the same against a nail to move the stem 16 in a direction opposite to the urging direction of the valve member 13 by the spring 17, thereby to release the valve member 13 from the valve seat 12.

However, the above conventional liquid storing member and its liquid outlet opening/closing mechanism has such disadvantages that it is troublesome and costly to manufacture and to assemble the same because of their relatively large number of constituting members and also of necessity of incorporating the spring 17 for urging the valve member 13 toward the valve seat 12.

Further, there is also such a problem, in the case the liquid has high viscosity, that a desired amount of liquid is not smoothly taken out if a form of a liquid depositing portion 14' disposed inside the liquid guiding portion 14 is inappropriate (e.g. too wide or too narrow).

SUMMARY OF THE INVENTION

Taking the above state of art into consideration, it is an object of the present invention to provide a fluid storing member and its fluid outlet opening/closing mechanism capable of overcoming the above-described problems.

In order to achieve the above object, a fluid storing member and its fluid outlet opening/closing mechanism related to the present invention comprises a valve seat having a portion formed of a magnetic material, the valve seat being housed in and attached at an opening of the fluid storing member and a valve member having a portion formed of a magnetic material and adapted to be seated on the valve seat, at least either of the valve member and the valve seat having the portion therof formed of the magnetic material. That is to say, the valve seat and the valve member may have a whole portion thereof formed of the magnetic material or may also have a partial portion thereof formed of a non-magnetic material. What is essential here is that the valve seat and the valve member are attracted with each other by a magnetic force thereby to permit the valve member to be seated on the valve seat.

For example, it is conceivable, as a specific embodiment of the present invention, that the valve seat comprises a ring-shaped member defining a concave spherical surface at an inner face thereof whereas the valve member is formed as a sphere having an outer periphery with a curvature corresponding to that of the spherical surface.

As the material generating a magnetic field, a permanent magnet, an electromagnetic material and the like may be used.

In the above fluid outlet opening/closing mechanism of the fluid storing member, a magnetic force acts between the valve seat and the valve member. Thus, if the fluid storing member is held still with its outlet being positioned downwardly, influenced not only by gravity but also by the magnetic force, the valve member is attracted toward the valve seat and then is seated thereon reliably. On the other hand, if the fluid storing member is shaken vertically such that an inertia force overwhelming the magnetic force (more exactly, a sum of the magnetic force and the gravity) is applied to the valve member, the inertia force causes the valve member to depart the valve seat.

Accordingly, by repeatedly shaking and stopping the fluid storing member, the fluid outlet opening/closing mechanism may be opened and closed reliably. Thus, the opening/closing mechanism of the invention is to be understood to assume a normally closed position due to the magnetic force exerted, to which position the valve member immediately returns from an opened position established by the inertial force of shaking the fluid storing member.

This fluid outlet opening/closing mechanism of the fluid storing member may be readily assembled merely by housing the valve member and a predetermined amount of fluid in the fluid storing member and then by attaching the valve seat at the outlet portion of the storing member; thus, this mechanism may be constituted by fewer elements.

Further, according to the present invention, such troublesome process as assembling the device after incorporating the spring for urging the valve member is not necessary. Thus, the problem of troublesome and costly assembly of the conventional outlet opening/closing mechanism of liquid storing member has been solved.

In addition, in the case of the fluid outlet opening/closing mechanism of the present invention, when the valve member is repeatedly seated on and departed from the valve seat by shaking the storing member, there occurs an inner air pressure producing a force to forcibly send the fluid from inside of the storing member to the ambience. Whereas, in the case of the conventional mechanism, the fluid is taken out of the storing member as being guided into a gap formed by releasing the valve member from the valve seat. Therefore, the fluid outlet opening/closing mechanism of the present invention is more reliable than the prior art in extracting the fluid.

It is to be noted, when the valve member departs the valve seat inside the liquid storing member, air is drawn into the storing member from outside. As a result, pressure inside the storing member is not reduced with the extraction of the liquid. Further, although the air is drawn into the storing member when the liquid is extracted therefrom as described above, since the storing member is positioned with its outlet portion placed downwardly, the inner air gravity acts on the liquid inside the storing member in a direction to help extracting the liquid from the storing member, whereby the liquid may be extracted smoothly.

BRIEF DESCRIPTION OF THE DRAWINGS

Accompanying drawings illustrate preferred embodiments of a fluid storing member and its fluid outlet opening/closing mechanism related to the present invention; in which.

DESCRIPTION OF THE PREFERRED EMBODIMENTS

Preferred embodiments of the present invention will be particularly described hereinafter with reference to the accompanying drawings.

Figure 1:
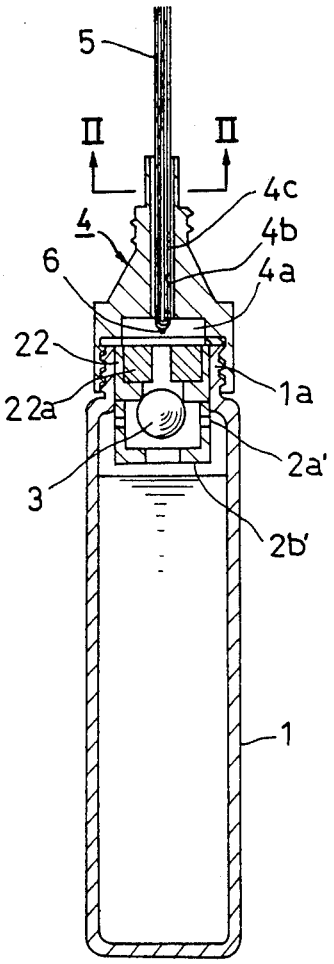
FIG. 1 is a longitudinal sectin of a manicure liquid applying device using the fluid outlet opening/closing mechanism.
Figure 2:
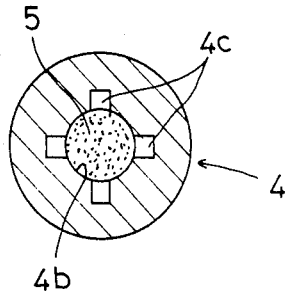
FIG. 2 is a cross section taken along line II—II in FIG. 1.
Figure 5:
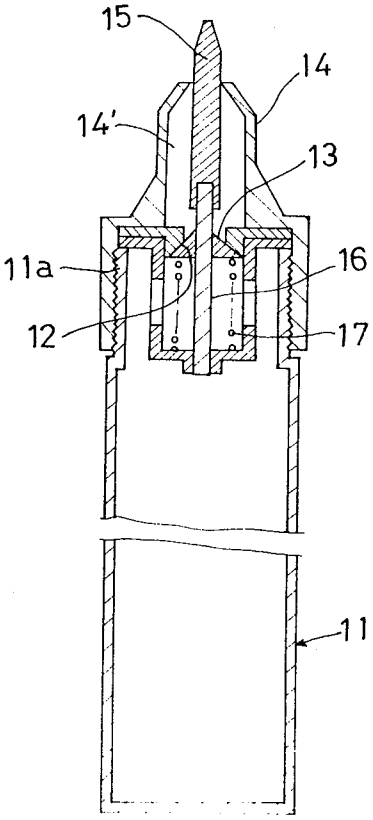
Fig. 5 PRIOR ART
FIG. 5 is a prior art longitudinal section showing a manicure liquid applying device using a conventional liquid outlet opening/closing mechanism.

Referring to FIG. 1, a reference numeral 1 denotes a liquid storing member related to the present invention having a bottom-equipped cylindrical form and adapted for storing therein a predetermined amount of manicure liquid. At an outlet portion 1*a* of the liquid storing member 1, there is attached a valve seat 2 constituted by a permanetly magnetic ring-shaped element 22*a* and defining concavely in an inner face thereof (a face forming an inner face of the storing member when the valve seat 22 is attached) a spherical surface 2*a*. Inside the storing member 1, there is housed along with a predetermined amount of manicure liquid a valve member 3 consititued by a steel spherical member having an outer periphery with a curvature corresponding to that of the spherical surface 2*a*, the valve member 3 being adapted to be seated on the valve seat 22 as shown in FIG. 1 The valve seat 22 and the valve member 3 essentially constitute a fluid outlet opening/closing mechanism related to the present invention.

Further, at the outlet portion 1a attaching the valve seat 22 of the storing member 1, there is provided a liquid at a temporary storing portion 4*a* guiding portion 4 for temporarily storing a one-use amount of manicure liquid and also for guiding the manicure liquid to an applying portion 5 attached at a leading edge of the guiding portion 4. More particularly, the applying portion 5 is attached to the leading edge of the guiding portion 4 in such a way that the applying portion 5 constituted by a brush member folded into two and then fixed by a stopper 6 is pressedly engaged into a through bore 4*b* defined at the leading edge of the guiding portion 4. It is to be noted that the applying portion 5 may be attached to the guiding portion 4 also in other manners, e.g. the applying portion 5 may be fixed at a point inside the through bore 4*b*.

In a peripheral face of the through bore 4*b*, there are defined in a longitudinal direction thereof a plurality of grooves 4*c* . . . for facilitating the guiding of the manicure liquid to the leading edge of the applying portion 5.

In the above liquid outlet opening/closing mechanism, a magnetic force acts between the valve seat 2*a* and the valve member 3. Thus, if the storing member 1 is held still with its opening 1a being positioned downwardly, influenced not only by gravity but also by the magnetic force, the valve member 3 is attracted toward the valve seat 2*a* and then is seated thereon reliably. On the other hand, if the storing member 1 is shaken vertically such that an inertia force overwhelming the magnetic force (more exactly, a sum of the magnetic force and the gravity) is applied to the valve member 3, the inertia force causes the valve member 3 to depart the valve seat 2*a*.

In the above embodiment, the valve seat 2 is formed of permanent magnet generating a magnetic field and the valve member 3 is formed of steel. Conversely, it is also possible to form the valve member 3 of a permanent magnet or both of the valve seat 2 and the valve member 3 of permanent magnets. Further, an electromagnetic material in place of the permanent magnet may be used for forming these elements. That is to say, any material may be used if a magnetic force acts between the valve seat 2 and the valve member 3 to attract each other. Furthermore, in forming the valve member and the valve seat in general, instead of forming whole these elements of magnetic material, only a portion thereof may be formed of the magnetic material, e.g. by coating the elements with magnetic paint.

The valve seat 22 has a valve member stopping portion 2*b'* defining transverse bores 2*a'* . . . for passing the liquid and adapted for controlling the position of the valve member.

As shown in FIG. 1 the valve member 3 is seated on the valve seat 22. A portion of this valve seat 22 that comes into contact with the valve member 3 may be formed of a resin having at an outlet portion thereof the magnetic material portion 22*a*. That is to say, the valve member 3 does not come into direct contact with the magnetic material portion 22*a*. It is possible to define in the resin portion a concave spherical surface for facilitating the seating movement of the valve member 3. If the portion of the valve seat 22 that comes into contact with the valve member 3 is formed of the resin as described above, by increasing a finish precision of a resin surface, tightness between the valve member and the valve seat may be improved. Therefore, even a geseous fluid may be tightly stored in the storing member 1.

In addition, in this case, such special arrangement for preventing the valve member 3 from becoming unable to close the bores of the valve seat 2*a* is not at all needed.

Figure 3:
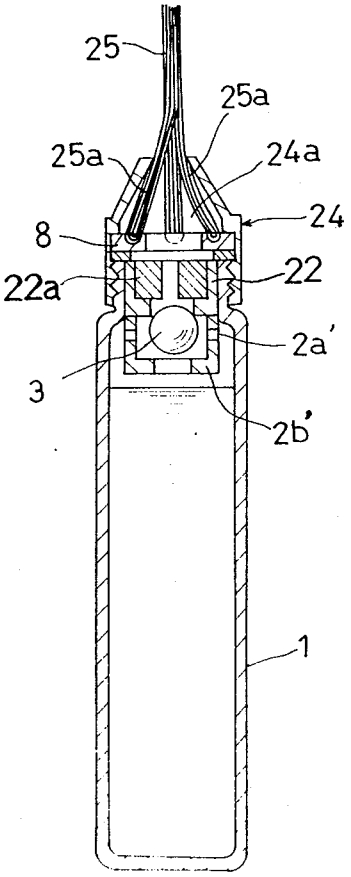
FIG. 3 is a longitudinal section showing an alternate first embodiment.

FIG. 3 (showing the valve member seated on the valve seat) illustrates an alternate embodiment in which the liquid guiding portion of the aforementioned is further improved.

In the present embodiment, a liquid-applying portion 25 is constituted by a plurality of liquid-applying pieces 25*a* having leading edges thereof intertwined with each other, the opposite edges of the piece 25*a* being implanted in a peripheral portion of a doughnut-shaped plate member 8 inwardly engaging a liquid-guiding portion 24. This arrangement permits a temporary storing portion 24*a* to have a conveniently enlarged unobstructed capacity, whereby a high viscosity matter such as manicure liquid may be readily extracted and applied through each applying piece 25*a*. The number of the applying pieces 25*a* is not limited in particular. Also, the material forming the plate member 8 may selectively comprise, e.g. a flexible material which may readily come into the inward engagement with the guiding portion 24.

Figure 4:
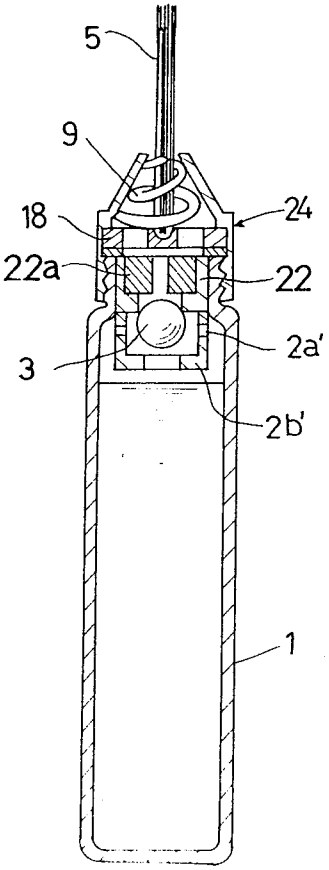
FIG. 4 is a longitudinal section showing an alternate second embodiment.

In place of constituting the applying portion by a plurality of applying pieces as shown in FIG. 3 the embodiment, as shown in FIG. 4 (showing the valve member seated on the valve seat), it is also possible to employ a single applying piece implanted in the plate member 18 inwardly engaging the guide portion 24 with its guiding part being wound by a spring member 9 (e.g. a helical or coiled spring). With this arrangement, the manicure liquid having a high viscosity may be smoothly extracted by means of this spring member 9, whereby a liquid applying opeation may be easily carried out. In this case, it is preferrable that the spring member 9 have a smooth surface in order to facilitate the above function. It is also preferrable that the spring member 9 be disposed not more outwardly than the guiding portion 24 such that this spring member 9 does not come into contact with and damage a surface of applied coating in the course of the liquid applying operation.

Moreover, it is needless to say that the fluid storing member and its fluid outlet opening/closing mechanism may be used not only for the manicure liquid applying device as described in the above embodiments but also may be used as an outlet opening/closing mechanism of a storing member for storing other kinds of liquid or gas. In the case of storing a gaseous matter, it is needless to say that the applying portion and the like described in the aforementioned embodiments are not necessary.

It is also to be noted here that in the following claims reference numerals are provided to constituent elements in order to make it easier to refer the same to the accompanying drawings but that this provision of reference numerals does not limit the present invention to the constructions illustrated in these figures.

What is claimed is:

1. A fluid outlet opening/closing mechanism for a fluid storing member, comprising:

a valve seat (22) having a portion that may be formed of a magnetic material, housed in a fluid storing member (1) and adapted to be attached to an outlet portion (1*a*) of said fluid storing member (1), said valve seat (22) including a stop portion (2*b*′); and a valve member (3) having a portion that may be formed of a magnetic material and disposed in a space surrounded by said stop portion (2*b*′) and said valve seat (22) adapted to be seated on said valve seat (22);

wherein at least either said portion of said valve seat (22) or said valve member (3), is constituted by a material capable of producing a magnetic field; whereby said valve seat and valve member cooperatively define a normally closed position for said opening/closing mechanism to which said mechanism immediately returns from an opened position established by an inertial force applied to said fluid storing member by shaking.

2. A fluid outlet opening/closing mechanism for a fluid storing member, as defined in claim 1, wherein said valve seat (2) is a ring-shaped member defining in an inner face thereof a concave spherical face (2*a*) and said valve member (3) is a spherical member having an outer periphery with a curvature corresponding to a curvature of said spherical face (2*a*).

3. A fluid outlet opening/closing mechanism for a fluid storing member, as defined in claim 1, wherein said material capable of generating a magnetic field is a permanent magnet.

4. A fluid storing member, comprising:

a fluid storing portion;

a fluid outlet portion having an opening/closing mechanism; including, a valve seat (22) having a portion formed of a magnetic material, housed in a fluid storing member (1) and adapted to be attached to said outlet portion (1*a*) of said fluid storing member (1), said valve seat (22) including a stop portion (2*b*′) and a valve member (3), having a portion that may be formed of a magnetic material and disposed in a space surrounded by said stop portion (2*b*′) and said valve seat (22) adapted to be seated on said valve seat (22);

wherein at least either said magnetic portion (22) or said valve member (3), being constituted by a material capable of generating a magnetic field; and a fluid applying portion extending from said fluid outlet portion; whereby said valve seat and valve member cooperatively define a normally closed position for said opening/closing mechanism to which said mechanism immediately returns from an opened position established by an inertial force applied to said fluid storing member by shaking.

5. A fluid storing member, as defined in claim 4, wherein said fluid applying portion (25) is constituted by a plurality of applying pieces (25*a*) intertwined with each other and implanted in a plate member (8) inwardly engaging a fluid guiding portion (24) of said fluid storing portion.

6. A fluid storing member, as defined in claim 4, wherein said fluid applying portion has a part thereof near a fluid guiding portion (24) wound by a spring member (9).

7. A fluid outlet opening/closing mechanism as claimed in claim 1 wherein said portion of said valve seat is formed of a material capable of producing a magnetic field, and said valve member is made of a material which is attracted by a magnetic field.

8. A fluid outlet opening/closing mechanism as claimed in claim 1, wherein:

said valve member is made of a material capable of producing a magnetic field; and said portion of said valve seat is made of a material which is attracted by a magnetic field.

9. A fluid outlet opening/closing mechanism as claimed in claim 4, wherein:

said portion of said valve seat is formed of a material capable of producing a magnetic field, and said valve member is made of a material which is attracted by a magnetic field.

10. A fluid outlet opening/closing mechanism as claimed in claim 4, wherein:

said valve member is made of a material capable of producing a magnetic field; and said portion of said valve seat is made of a material which is attracted by a magnetic field.

* * * * *